United States Patent [19]

Fields et al.

[11] 4,372,787

[45] Feb. 8, 1983

[54] METHOD FOR ULTRASONIC CLEANING OF RADIATORS

[76] Inventors: John T. Fields; Cecil D. Lee, both of 810 E. 6th St., Tulsa, Okla. 74120

[21] Appl. No.: 280,908

[22] Filed: Jul. 6, 1981

[51] Int. Cl.[3] ..... B08B 3/12

[52] U.S. Cl. ..... 134/1; 134/184; 165/95

[58] Field of Search ..... 134/1, 184; 165/95

[56] References Cited

U.S. PATENT DOCUMENTS

| | | | |
|---|---|---|---|
| 1,983,084 | 12/1934 | Janus | 134/102 |
| 2,170,730 | 8/1939 | Rodieck | 134/170 X |
| 2,580,800 | 1/1952 | Lavender | 134/184 X |
| 2,987,068 | 6/1961 | Branson | 134/184 |
| 3,096,774 | 7/1963 | Rand | 134/1 X |
| 3,295,596 | 1/1967 | Ostrofsky et al. | 165/95 X |
| 3,573,983 | 4/1971 | Antonevich | 134/1 |
| 3,937,236 | 2/1976 | Runnells | 134/184 |
| 4,082,565 | 4/1978 | Sjolander | 134/1 |
| 4,120,699 | 10/1978 | Kennedy et al. | 165/95 X |

OTHER PUBLICATIONS

*Anti-Corrosion,* "Ultrasonic Cleaning Techniques", Sep. 1974, pp. 17-21.

*Primary Examiner*—Marc L. Caroff
*Attorney, Agent, or Firm*—Mildred K. Flowers

[57] ABSTRACT

A radiator having a header is cleaned by at least partially immersing the radiator in a cleaning liquid so that the header is immersed in the cleaning liquid and then applying ultrasonic energy to the cleaning liquid at an energy sufficient to cause cavitation of the liquid. The header is oriented in a direction toward the source of the ultrasonic energy, whereby the header is in closer proximity to the energy source than the remainder of the radiator, so that the ultrasonic energy is initially directed onto the face of the header.

3 Claims, 6 Drawing Figures

METHOD FOR ULTRASONIC CLEANING OF RADIATORS

BACKGROUND OF THE INVENTION

1. Field of the Invention

This invention relates to improvements in method and means for cleaning radiators and more particularly, but not by way of limitation, to an ultrasonic method and means for cleaning radiators.

2. Description of the Prior Art

Radiators of all sizes are in widespread use today in many areas, such as the conventional vehicle radiators, industrial radiators, and the like. During utilization of these radiators, the header members which normally support the outer ends of the heat exchanger tubes of the radiator, frequently become encrusted with residue materials from the fluids normally utilized in connection with the radiators. This accumulation of residue, and the like, hinders the efficient operation of the radiator, and as a result it is common practice to clean the radiators for improving the operational performances thereof. The radiator cleaning methods in use today do not efficiently remove the accumulated residue. For example, parts of the header or other portions of the radiator, usually have hidden crevices, or troublesome areas around the radiator tubes where they extend through the header wherein excessive sulphates and/or carbonate particles build up, and the usual hot soak tank or abrasive blast methods utilized for cleaning the radiators cannot remove all of the particle build up. As a result, it is frequently necessary to manually clean away much of the undesirable material adhered to the radiator parts. This is not only expensive and time consuming, but also the completed cleaning operation is somewhat ineffectual since it is substantially impossible to completely clean the radiator by the present day methods.

SUMMARY OF THE INVENTION

The present invention contemplates a novel method and means for quickly and efficiently cleaning radiators in a manner for overcoming the foregoing disadvantages. The novel method and means comprises an ultrasonic cleaning method wherein a suitable housing having a transducer means disposed therein and operably connected with suitable ultrasonic generator means for actuation thereof in the usual or well known manner. Suitable heating means is secured in the housing, such as strip heaters, or the like, and support means is provided in the housing for supporting a radiator in particularly selected space relation with respect to the transducer means. A suitable cleaning liquid, which is a technically compounded blend of the proper chemicals for performing the cleaning operation, is placed in the housing and surrounds the transducer means and support means. In order to clean a radiator, the heating means may be activated for heating of the cleaning liquid to a preselected temperature, and the transducer means is activated by the ultrasonic generator means for converting electrical energy into mechanical energy. The ultrasonic cleaning operation depends upon cavitation, which is the rapid formation and violent collapse of minute bubbles or "cavities" in the cleaning liquid. This agitation by countless small and intense imploding bubbles creates a highly effective scrubbing of both exposed and hidden surface of parts immersed in the cleaning solution without affecting the dimensional tolerances of the parts. Thus, the radiator to be cleaned, and particularly the header portion thereof, may be immersed in the cleaning liquid and supported by the support means and maintained in the cleaning fluid throughout aa sufficient time period for effecting a complete and efficient cleaning of the header and/or other parts of the radiator. Generally speaking, the time required for a complete cleaning operation is approximately eight minutes, or less, depending upon the condition of the radiator being cleaned. Not only is the time required for the cleaning of the radiator a minimum, but also the end results of the cleaning operation is of a quality completely unobtainable with present day radiator cleaning operation. The novel method and means is simple and efficient in operation and economical and durable in construction and utilization.

DETAILED DESCRIPTION OF THE PREFERRED EMBODIMENT

Figure 3:
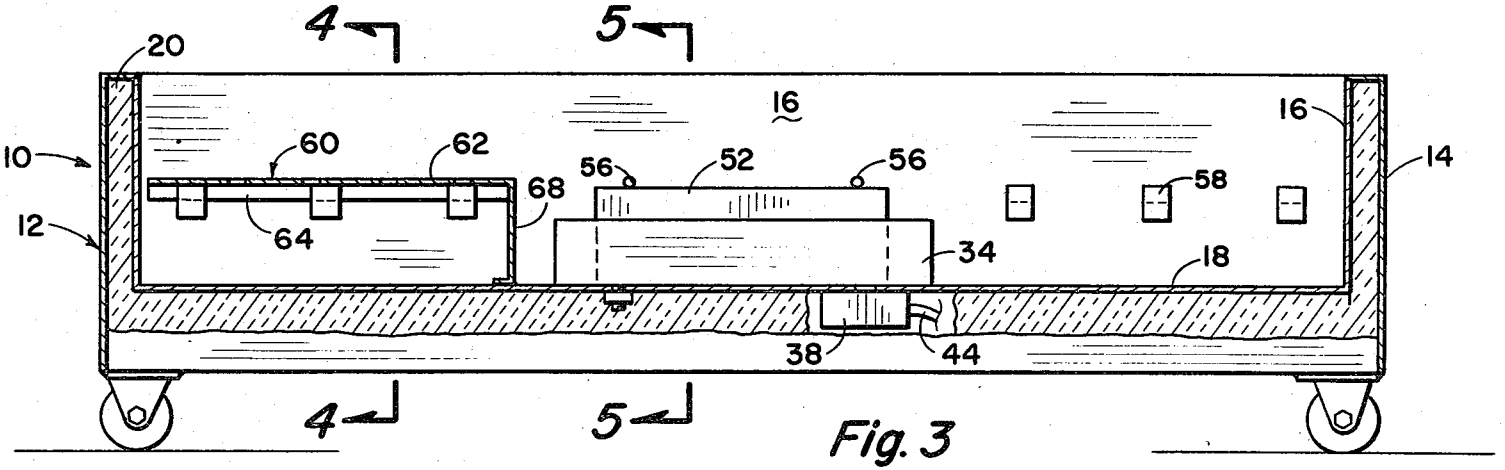
FIG. 3 is a sectional elevational view of an ultrasonic radiator cleaning apparatus embodying the invention.
Figure 4:
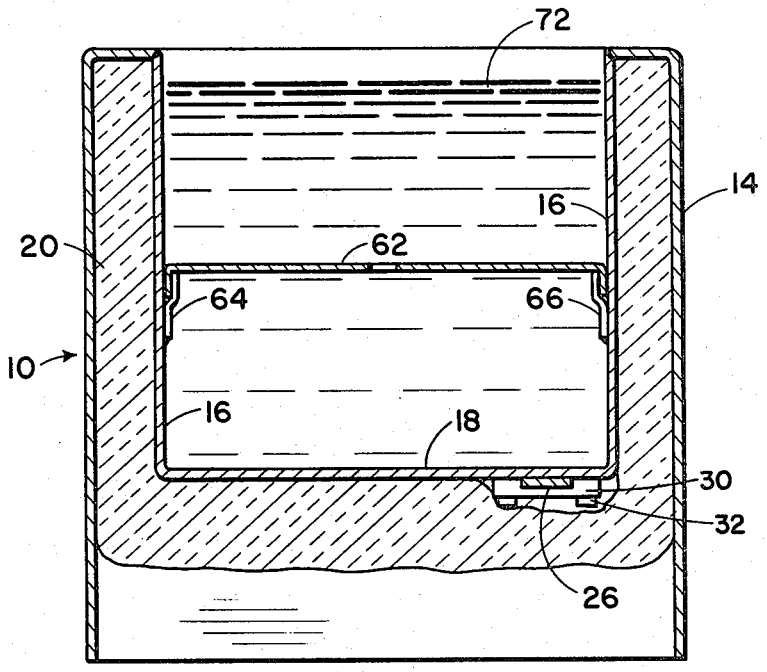
FIG. 4 is a view taken on line 4—4 of FIG. 3.
Figure 5:
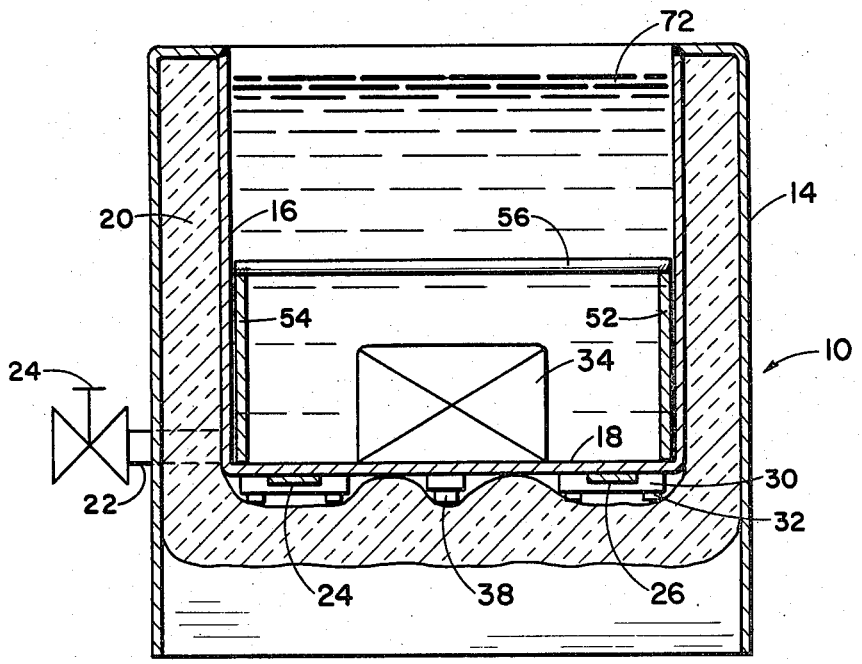
FIG. 5 is a view taken on line 5—5 of FIG. 3.

Referring to the drawings in detail, reference character 10 generally indicates an ultrasonic radiator cleaning apparatus comprising a housing 12, preferably of a substantially rectangular configuration, but not limited thereto, and having an outer peripheral wall means 14 in spaced relation with respect to an inner peripheral wall means 16, as particularly shown in FIGS. 3, 4 and 5. A bottom plate 18 is welded or otherwise rigidly secured to the inner wall means 16, and a suitable insulating material 20 is interposed between the walls 14 and 16 and disposed below the bottom plate 18 and secured in place in any suitable manner (not shown). Suitable discharge port means 22 extends through the walls 14 and 16 to provide communication between the interior and exterior of the housing 12, and a suitable shut-off valve 24 is preferably provided for the discharge port means 22 for facilitating draining of the interior of the housing 12 as will be hereinafter set forth in detail.

Figure 6:
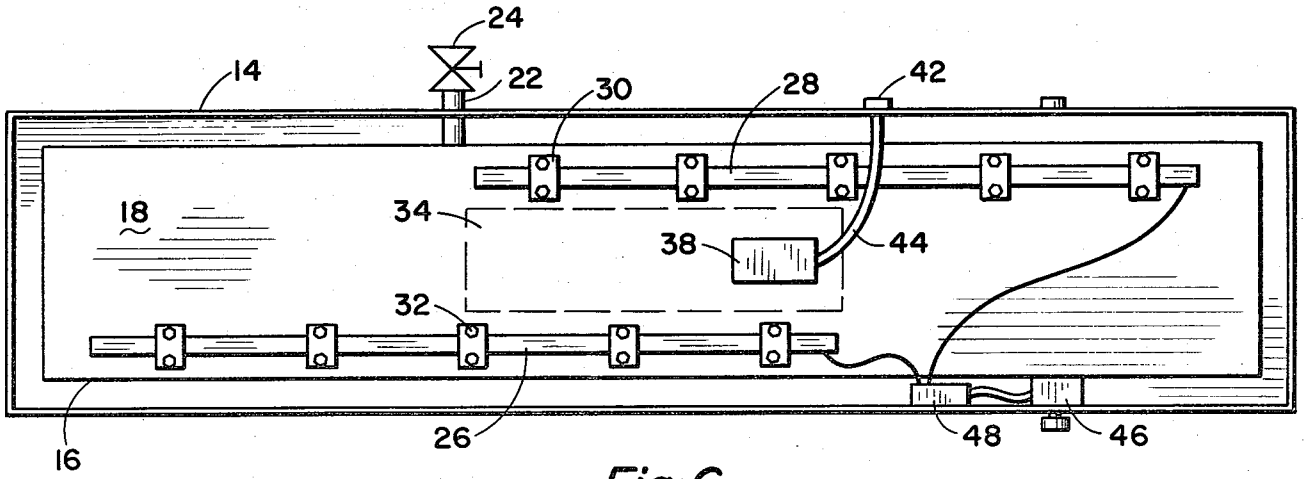
FIG. 6 is a bottom view of an ultrasonic radiator cleaning operation embodying the invention.

Suitable heating means, such as longitudinally extending spaced strip heaters 26 and 28 (FIG. 6) are secured to the outer surface of the bottom plate 18 in any well known manner, such as by strap means 30 bolted to the plate 18 by suitable bolts 32, or the like. The heaters 26 and 28 are disposed inboard of the insulation material 20, and the insulation material protects the exterior of the apparatus 10 from undue contamination from the heaters, as is well known. The heaters 26 and 28 may be connected with a source of power by suitable conduit means 29 extending through the wall 14, as is well known. A suitable transducer means 34 is disposed on the inner surface of the bottom plate 18 and may be secured thereto in any well known manner, such as by suitable bolts 36 (FIG. 3) extending through the plate 18. The transducer means 34 is preferably an immersible transducer of the type manufactured and sold by Branson Cleaning Equipment Company, Parrott Drive, Shelton, Connecticut, and the junction box means 38 normally provided therewith may be suitably mounted on the outer surface of the plate 18 for operable connection with an ultrasonic generator 40 of the type also manufactured and sold by Branson Cleaning Equipment Company. Of course, suitable aperture means 42 is provided in the wall means 14 for receiving the conduit means 44 therethrough which operably connects the junction box means 38 with the ultrasonic generator means 40. In addition, it is preferable to provide a suitable thermostat means 46, which may be mounted on the housing 12 in any well known manner for operable connection with the heaters 26 and 28 through a suitable relay means 48.

Figure 2:
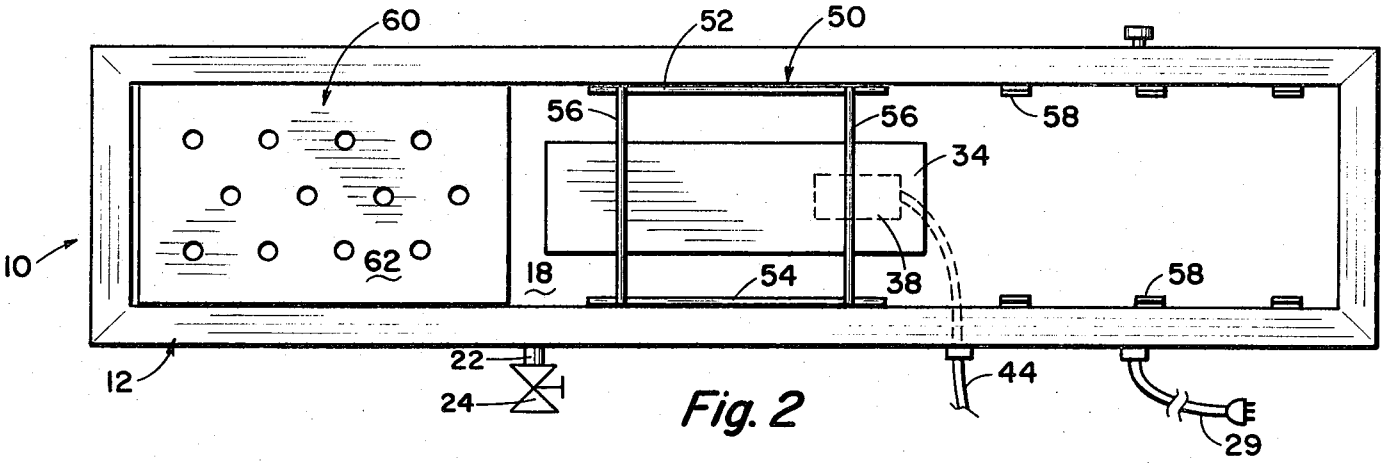
FIG. 2 is a plan view of an ultrasonic radiator cleaning apparatus embodying the invention.

A support rack assembly 50 is removably disposed within the housing 12 and comprises a pair of spaced side plates 52 and 54 adapted for disposition adjacent the inner periphery of the wall means 16 in the proximity of the transducer means 34 and spaced apart by a plurality of cross members 56 which span the width of the housing between the sidewall 16, as particularly shown in FIG. 2. The cross members 56 are disposed at a preselected height above the upper limit of the transducer 34 for a purpose as will be hereinafter set forth, with the spacing between the cross member 56 and transducer 34 preferably being approximately two inches, but not limited thereto. A plurality of spaced holder or clip members 58 may be suitably secured to the inner periphery of the wall means 16 in spaced relation as shown in FIGS. 2 and 3 for removably supporting support blocks 60, only one of which is shown in FIGS. 2 and 3. The support blocks 60 may be of any suitable construction, and as shown herein each comprises a perforated plate member 62 having downwardly depending flanges 64 and 66 (FIG. 4) extending longitudinally along the opposite sides thereof for engagement with the clips 58 for removably securing the plate 62 within the housing 12 in spaced relation with respect to the bottom plate 18. In addition, it is preferable to provide a transversely extending downwardly depending support member 68 along one end of the plate 62 for supporting the plate from the upper surface of the plate 18. The clips 58 are particularly spaced above the plate 18 for supporting the perforated plate or plates 62 at a preselected distance above the upper limit of the transducer means 34, said preselected distance preferably being the same as the distance between the cross member 56 and the transducer means 34.

In order to perform an ultrasonic cleaning operation on a radiator 70, a suitable cleaning liquid 72 is admitted into the interior of the housing 12 through the open upper end 74 thereof, as shown in FIGS. 4 and 5. The cleaning liquid 72 is a technically compounded blend of the proper chemicals to perform the cleaning job, such as that sold by Arsco, Inc. under the name Quikstrip 240. Of course, the cleaning solution or liquid is particularly selected in accordance with the material which is being cleaned, i.e. copper, brass, aluminum, plastic, steel, or the like. Of course, the housing 12, support members 50 and 60, clips 58, and other elements exposed to the cleaning liquid 72 are preferably constructed from stainless steel, or other suitable corrosion resistant material for assuring a prolonged useful life for the apparatus 10.

The heaters 26 and 28 are activated in the usual manner for applying heat to the cleaning liquid. The degree of heating of the cleaning liquid is not critical, but a sufficiently high temperature will be found to speed the overall cleaning operation. At the same time, the transducer means 34 may be activated by the normal operation of the ultrasonic generator means 40 for agitation of the cleaning fluid to provide the cavitation effect hereinbefore set forth. In addition, the supportrack 50 and at least support means 60, and preferably two thereof, are placed in the housing 12 for establishing a support surface spaced above the upper limit of the transducer means 24. It has been found, as a practical matter, that efficient results are obtained if the object being cleaned is maintained at a distance of two inches above the transducer means.

Figure 1:
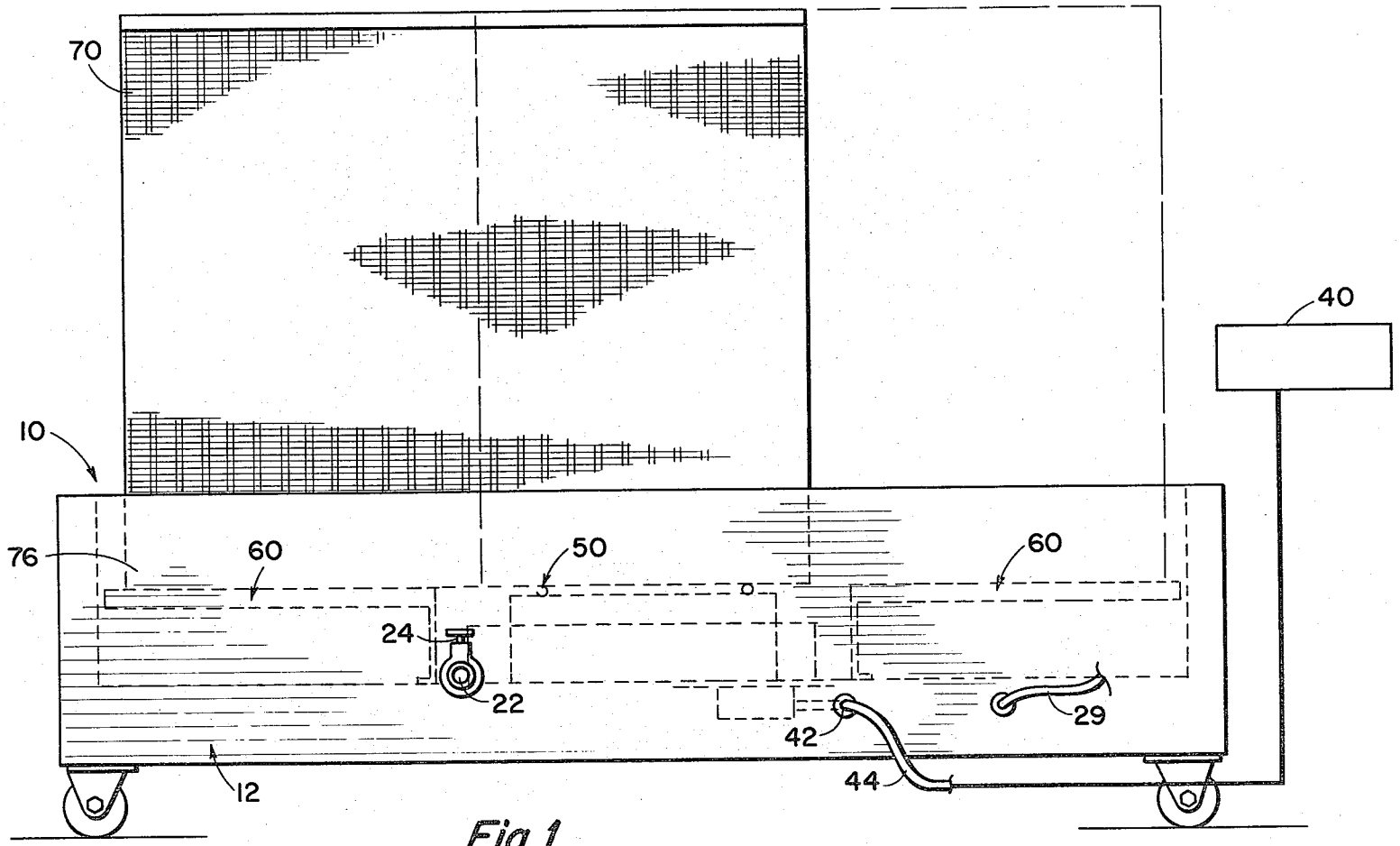
FIG. 1 is a side elevational view of an ultrasonic radiator cleaning apparatus embodying the invention with portions shown in dashed lines for purpose of illustration and showing a radiator disposed therein.

The radiator 70 may then be immersed within the liquid bath 72, preferably with one header member 76 thereof supported by the support means 50 and 60, as particularly shown in solid lines in FIG. 1. An alternate position for the radiator is shown in broken lines in FIG. 1, and it is to be noted that it is preferable to construct the housing 12 of sufficient length for receiving substantially large radiators therein, but of course the dimension of the housing may be as required in accordance with the particular utilization required thereof. The heated and ultrasonically agitated cleaning liquid 72 surrounding the radiator portion immersed therein quickly and efficiently removes substantially all residue, or the like, which is deposited on the radiator. It has been found that a time period of approximately eight minutes is sufficient for cleaning the most difficult to clean objects, with lesser times being required for radiators requiring less cleaning action. The accumulated deposits are removed even from hidden crevices, and the like, resulting in a substantially new looking radiator header upon removal of the radiator from the cleaning liquid 72.

Of course, it is practical or preferable to provide a suitable cover member (not shown) for the open upper end 74 of the housing 2 for covering of the exposed cleaning fluid 72 when the apparatus 10 is not in use. In addition, it may be desirable to remove the cleaning fluid from the housing 12, such as to change the chemicals in accordance with the material of the object being cleaned, or the like. The valve 24 may be opened in the well known manner for draining of the cleaning fluid 72 through the discharge port means 22.

From the foregoing it will be apparent that the present invention provides a novel method and means for ultrasonic cleaning of radiators wherein housing means having transducer means provided therein operably connected with an ultrasonic generator means and surrounded by a suitable cleaning liquid whereby ultrasonic energy is pressed upon the cleaning liquid for quickly and efficiently removing any deposits clinging to the radiator. The ultrasonic cleaning method results in an end product resembling a new radiator subsequent to the cleaning operation, thus providing an efficient cleaning result not heretofore possible.

Whereas the present invention has been described in particular relation to the drawings attached hereto, it should be understood that other and further modifications, apart from those shown or suggested herein may be made within the spirit and scope of this invention.

What is claimed is:

1. A method of cleaning a radiator having a header portion supporting heat exchanger tubes and comprising the steps of:

(a) heating a reservoir of cleaning liquid;

(b) impressing ultrasonic energy into the cleaning liquid with at least one ultrasonic energy producing means at an energy sufficient to cause cavitation of the cleaning liquid;

(c) supporting said radiator in the reservoir so that the header portion is immersed in the cavitated cleaning liquid and disposed in spaced relationship with the ultrasonic energy producing means;

(d) orienting the header portion in the cleaning liquid in a direction toward the ultrasonic energy producing means whereby the header is in closer proximity to the ultrasonic energy producing means than the remaining portions of the radiator; and (e) maintaining the header portion of the radiator in the cavitated cleaning liquid for a time sufficient to effect cleaning thereof.

2. A method of cleaning a radiator having a header portion supporting heat exchanger tubes and comprising the steps of:

(a) heating cleaning liquid in an open top reservoir;

(b) impressing ultrasonic energy into the cleaning liquid with at least one ultrasonic energy producing means at an energy sufficient to cause cavitation of the cleaning liquid;

(c) partially immersing said radiator in the cleaning liquid in the open reservoir so that the header portion is immersed in the cavitated cleaning liquid and supported in spaced relationship to the ultrasonic energy producing means; and (d) orienting the header portion in the cleaning liquid so that the header portion is disposed in closer relationship to the ultrasonic energy producing means than the remaining portions of the radiator in order that the energy produced by the ultrasonic energy producing means is initially directed onto the face of the header portion.

3. A method of cleaning radiators as set forth in claims 1 or 2 and including the step of thermostatically monitoring the heating of the cleaning liquid.

* * * * *